United States Patent [19]

Sakurai et al.

[11] 4,083,344

[45] Apr. 11, 1978

[54] SYSTEM FOR CONTROLLING VAPORIZED HYDROCARBON OF FUEL FOR A GASOLINE ENGINE

[75] Inventors: Shigenori Sakurai, Toyota; Shigeo Murakami, Okazaki; Masanori Torii, Toyota, all of Japan

[73] Assignee: Toyota Jidosha Kogyo Kabushiki Kaisha, Toyota, Japan

[21] Appl. No.: 685,174

[22] Filed: May 11, 1976

[30] Foreign Application Priority Data

Jan. 8, 1976 Japan ..... 51-1142

[51] Int. Cl.[2] ..... F02M 59/00

[52] U.S. Cl. ..... 123/136

[58] Field of Search ..... 123/136

[56] References Cited

U.S. PATENT DOCUMENTS

| | | | |
|---|---|---|---|
| 3,352,294 | 11/1967 | Biller et al. | 123/136 |
| 3,575,152 | 4/1971 | Wentworth | 123/136 |
| 3,730,158 | 5/1973 | Amand | 123/136 |
| 3,844,264 | 10/1974 | Grainger | 123/136 |
| 3,995,604 | 12/1976 | Brandsteher | 123/136 |

*Primary Examiner*—Ronald B. Cox

[57] ABSTRACT

There is disclosed a system for controlling vaporized hydrocarbon of fuel for a gasoline engine wherein the vaporized hydrocarbon is led from a carburetor float chamber to a canister through a pipe in which a chamber for separating fuel and vapor is provided.

22 Claims, 2 Drawing Figures

SYSTEM FOR CONTROLLING VAPORIZED HYDROCARBON OF FUEL FOR A GASOLINE ENGINE

BACKGROUND OF THE INVENTION

The present invention relates to a system for controlling vaporized hydrocarbon of fuel for a gasoline engine.

A system is known which leads the hydrocarbon evaporated from a fuel tank to combustion chambers where the hydrocarbon is burned and discharged into the atmosphere in the form of noninjurious gas. In such a system, the gasoline vapors subjected to evaporative dissipation from the gasoline fuel tank of a gasoline engine-driven vehicle suchas an automobile or the like are so caused to be kept in storage in a predetermined place, such as in a canister or the like containing an absorbent like activated carbon, and are then sucked into an engine at the proper occasion, and then subjected to combustion in combustion chambers.

SUMMARY OF THE INVENTION

It is an object of the present invention to provide a system for controlling vaporized hydrocarbon of fuel for a gasoline engine wherein the hydrocarbon vaporized from a carburetor float chamber may be treated properly to cope with an exhaust gas discharged from an internal combustion engine-driven vehicle.

According to an aspect of the present invention, a system is provided which leads the hydrocarbon vaporized from a carburetor fuel chamber to a canister through connecting means such as a connecting pipe which system includes a fuel and vapor separating chamber connected through a purge pipe with the carburetor.

DETAILED DESCRIPTION OF PREFERED EMBODIMENT

Figure 1:
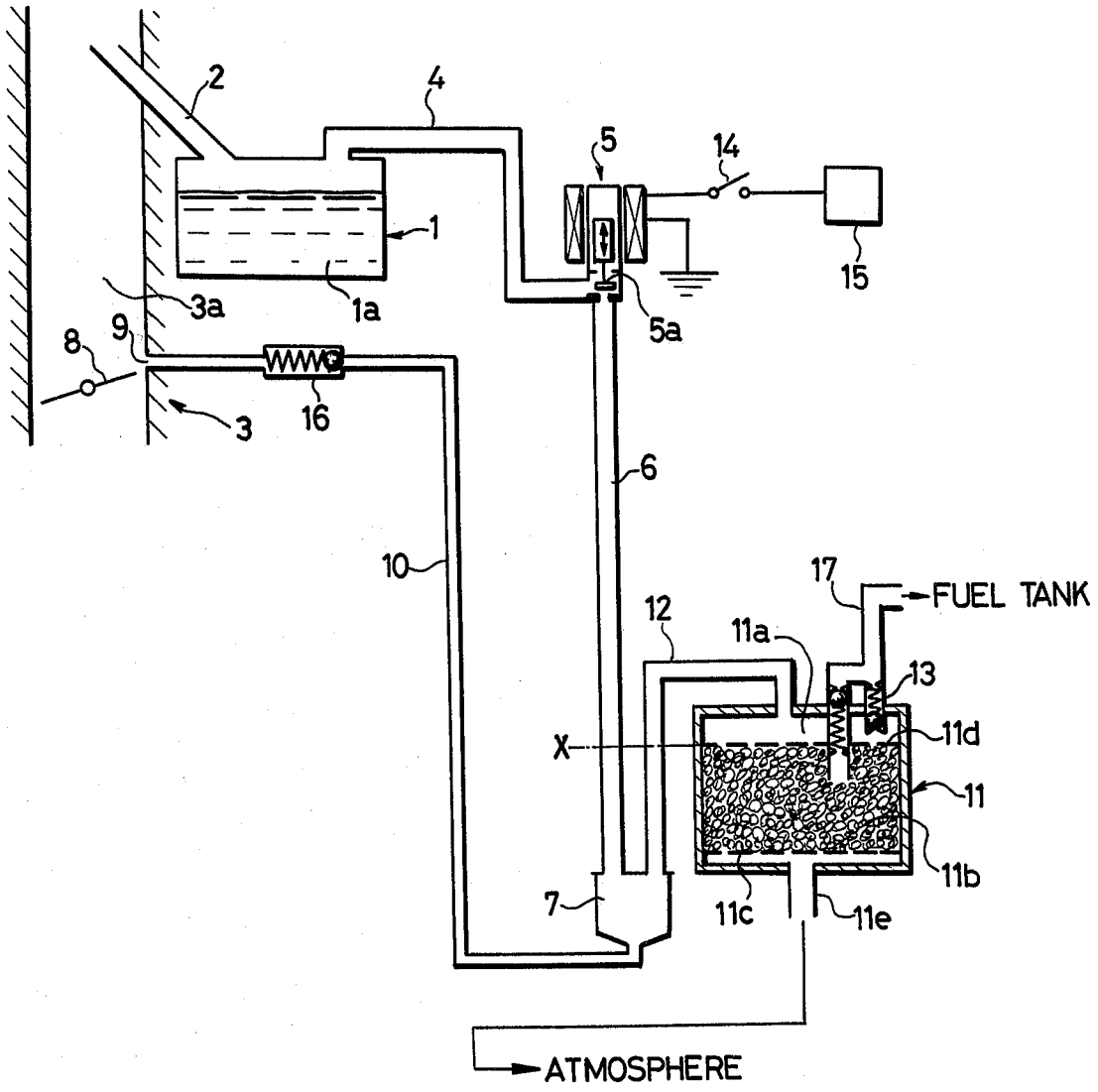
FIG. 1 is a schematic sectional elevational view of a system for controlling the vaporized hydrocarbon of fuel for an internal combustion engine, according to an embodiment of the present invention.
Figure 2:
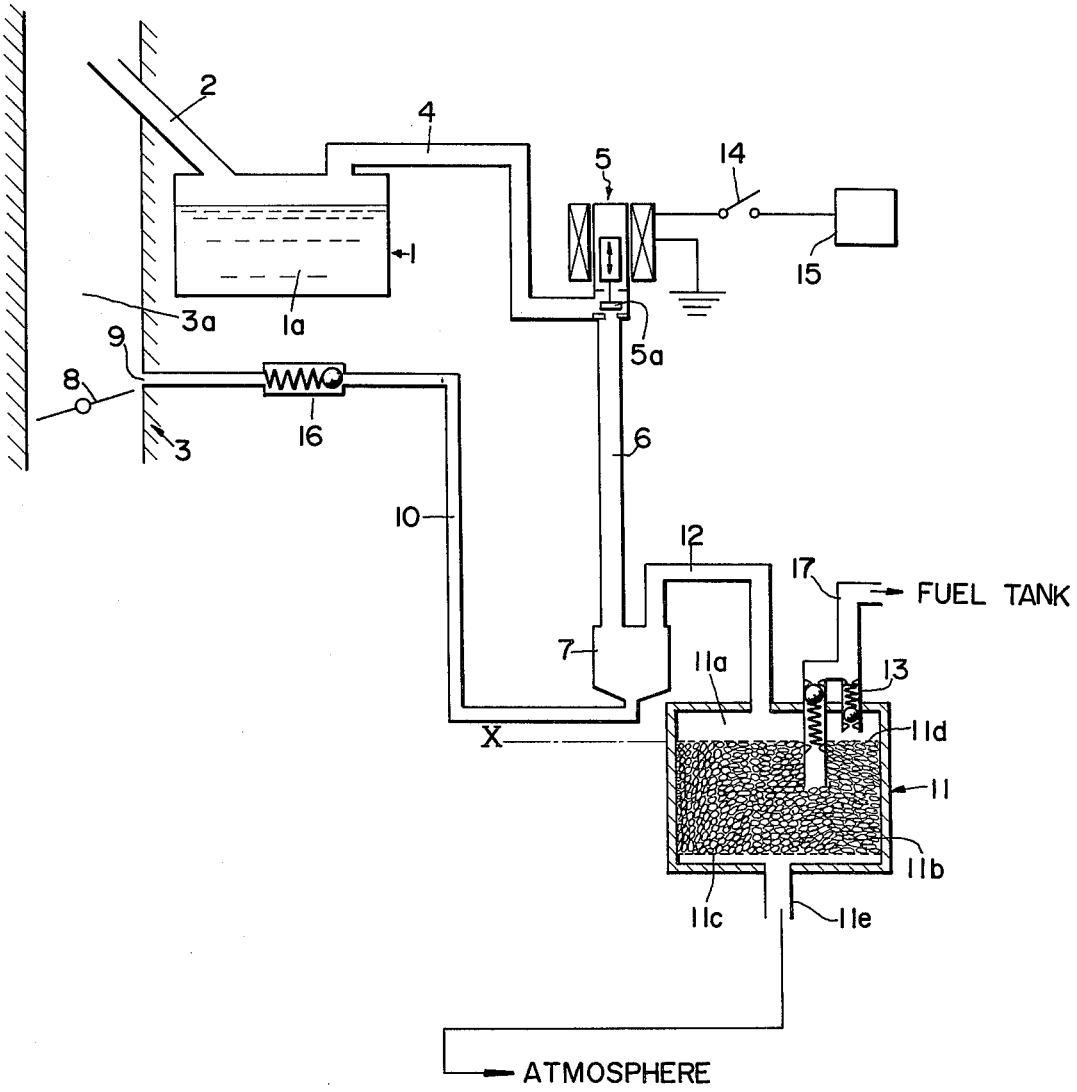
FIG. 2 is a schematic sectional elevation view illustrating an alternative embodiment of the present invention.

Referring to FIG. 1, a float chamber 1 for a carburetor generally designated at 3 contains fuel 1*a* therein for an internal combustion engine (not shown). An inner vent 2 of the float chamber 1 is connected with a suction pipe 3*a* of the carburetor 3 while an outer vent 4 thereof is connected through connecting means such as a pipe 6 and a pipe 12 with a canister 11. An electromagnetic valve 5 is provided in the pipe 6 between the float chamber 1 and the canister 11. The valve 5 is electrically connected with an ignition key 14 which is in turn connected electrically with a battery 15. The valve stem 5*a* of the valve 5 is actuated in response to ON-OFF action of the key 14, thereby to close the passage of the connecting pipe 6 in order to stop the flow of the hydrocarbon vaporized from the fuel 1a in the float chamber 1.

A fuel and vapor separating chamber 7 is connected through the pipe 6 with the float chamber 1, through the pipe 12 with the upper space 11*a* in the canister 11, and through a purge pipe 10 with the carburetor 3, respectively. A purge port 9 of the purge pipe 10 is near a throttle valve 8 provided conventionally in the suction pipe 3*a*. A check valve 16 is provided in place in the purge pipe 10.

The canister 11 contains an absorbent 11*b* such as activated carbon positioned between a pair of perforated plates 11*c* and 11*d*. The separating chamber 7 is preferably positioned below the upper level X of the absorbent 11*b*. The canister 11 is in fluid communication with the atmosphere through a pipe 11*e*. A check valve 13 is provided in the upper portion of the canister 11. The check valve 13 of a type as shown in FIG. 1 has two passages one of which is connected with the upper space in the canister 11 and the other of which is inserted in the absorbent 11*b*. The canister 11 is in fluid communication through the check valve 13 and a pipe 17 to a fuel tank (not shown).

In operation, the gasoline vapor in the float chamber 1 is led into the suction pipe 3A by way of the inner vent 2, and concurrently into the fuel separation chamber 7 by way of the outer vent 4, the electromagnetic valve 5 and the connecting pipe 6. The fuel separation chamber 7 as stated above is triple connected with the purge pipe 10 which is in turn connected with the purge port 9 provided the vicinity of the throttle valve 8; with the connecting pipe 12 connected with the canister 11; and with the connecting pipe 6. Since fuel separation chamber 17 is positioned between the float chamber and the canister 11, the fuel evaporated gas led into the fuel separation chamber 7 from in the float chamber 1 of the vaporizer by way of the electromagnetic valve 5 and the connecting pipe 6 is separated into a liquid matter or fuel and a gaseous matter or vaporized hydrocarbon. Such liquid gas as formed by the oscillation of a vehicle and the condensation of an evaporated gas at the later stage is properly prevented from directly flowing into the canister 11, whereby an irregular situation in which the absorbent 11*b*, activated carbon or the like, contained in the canister 11 is subjected to deterioration at an early stage, is properly checked from occuring. Furthermore, the electromagnetic valve 5, is connected with the battery 15 by way of the ignition key 14 so that it causes the connecting pipe 6 to be closed by inserting the ignition key 14 in place; however, when the engine is stopped, the electromagnetic valve 5 opens the connecting pipe 6 and the fuel evaporated gas in the float chamber 1 is led into the canister 11 by way of the fuel separation chamber 7, and the gas is kept from being subjected to evaporative dissipation into the atmosphere as long as the engine is kept turned off As elucidated in the preceding paragraphs, when the present invention is applied in a proper manner, no liquid fuel is allowed to flow into the absorbent contained in the canister, whereby the canister is effectively prevented from being subjected to deterioration.

Also, it is to be noted that variations in the system described herein will be apparent to those skilled in the art that various modifications and/or changes in the embodiment disclosed herein can be made without departure from the invention. For example, the separating chamber 7 may be positioned above the upper level X of the absorbent 11b. It is expressly intended therefore that the foregoing is illustrative of preferred embodiments only, not limiting, and that the true spirit and scope of the present invention be determined by reference to the appended claims.

What is claimed is:

1. A system for controlling vaporized hydrocarbon of fuel for a gasoline engine, comprising:

a carburetor float chamber having inner and outer vents, said float chamber being connected through said inner vent thereof with a carburetor for a gasoline engine driven vehicle;

a canister containing an absorbent therein; and means for connecting said outer vent of said float chamber with said canister so that the vaporized hydrocarbon may be led from said float chamber to said canister, said connecting means including a chamber positioned fluidly intermediate said float chamber and said canister for separating fuel and vapor therein.

2. The system of claim 1 wherein said connecting means is a connecting pipe.

3. The system of claim 1 wherein said separating chamber is connected with a purge pipe.

4. The system of claim 1 which further comprises an electromagnetic valve provided in place between said float chamber and said canister for controlling the flow of the vaporized hydrocarbon through said connecting pipe.

5. The system of claim 4 wherein said electromagnetic valve is actuated in response to the ON-OFF action of an ignition key which is electrically connected with said electromagnetic valve and a battery, respectively.

6. The system of claim 3 wherein said purge pipe is connected with said carburetor at a position near from a throttle valve provided therein.

7. The system of claim 3 wherein a check valve is provided in position in said purge pipe.

8. The system of claim 4 wherein said separating chamber is provided in position between said electromagnetic valve and said canister.

9. The system of claim 1 wherein said separating chamber is positioned below the upper level of said absorbent.

10. The system of claim 1 wherein said separating chamber is positioned above the upper level of said absorbent.

11. A system for controlling vaporized hydrocarbon of fuel for a gasoline engine comprising:

a carburetor float chamber having inner and outer vents, said float chamber being connected through said inner vent thereof with a carburetor for a gasoline engine-driven vehicle;

a canister containing an absorbent therein; and a connecting pipe for connecting said outer vent of said float chamber with said canister so that the vaporized hydrocarbon may be led from said float chamber to said canister, said connecting pipe including a chamber for separating fuel and vapor therein and a purge pipe that is connected with said carburetor at a position near a throttle valve provided therein, there being further included an electromagnetic valve provided in place between said float chamber and said canister for controlling the flow of the vaporized hydrocarbon through said connecting pipe, said electromagnetic valve being actuated in response to the ON-OFF action of an ignition key which is electrically connected with said electromagnetic valve and a battery, respectively.

12. The system of claim 11 wherein a check valve is provided in position in said purge pipe.

13. The system of claim 11 wherein said separating chamber is provided in position between said electromagnetic valve and said canister.

14. The system of claim 11 wherein said separating chamber is positioned below the upper level of said absorbent.

15. The system of claim 11 wherein said separating chamber is positioned above the upper level of said absorbent.

16. A system for controlling vaporized hydrocarbon of fuel for a gasoline engine, comprising:

a carburetor float chamber having inner and outer vents, said float chamber being connected through said inner vent thereof with a carburetor for a gasoline enginedriven vehicle;

a canister containing an absorbent therein; and a connecting pipe for connecting said outer vent of said float chamber with said canister so that the vaporized hydrocarbon may be led from said float chamber to said canister, said connecting pipe including a chamber for separating fuel and vapor therein and a purge pipe that is connected with said carburetor at a position near a throttle valve provided therein.

17. The system of claim 16 which further comprises an electromagnetic valve provided in place between said float chamber and said canister for controlling the flow of the vaporized hydrocarbon through said connecting pipe.

18. The system of claim 17 wherein said electromagnetic valve is actuated in response to the ON-OFF action of an ignition key which is electrically connected with said electromagnetic valve and a battery, respectively.

19. The system of claim 16 wherein a check valve is provided in positioned in said purge pipe.

20. The system of claim 17 wherein said separating chamber is provided in position between said electromagnetic valve and said canister.

21. The system of claim 16 wherein said separating chamber is positioned below the upper level of said absorbent.

22. The system of claim 16 wherein said separating chamber is positioned above the upper level of said absorbent.

* * * * *